United States Patent [19]

Pineau

[11] Patent Number: 5,058,325

[45] Date of Patent: Oct. 22, 1991

[54] MACHINE FOR THE ABRASIVE MACHINING OF CYLINDRICAL JOURNALS ON COMPONENTS, IN PARTICULAR FOR MACHINING JOURNALS AND CRANK PINS ON CRANKSHAFTS USING ABRASIVE MATERIAL

[75] Inventor: Jean C. Pineau, Chailly-en-Bière, France

[73] Assignee: Societe Procedes Machines Speciales, S.P.M.S., Evry Cedex, France

[21] Appl. No.: 409,794

[22] Filed: Sep. 20, 1989

[30] Foreign Application Priority Data

Sep. 27, 1988 [FR] France ..... 88 12622

[51] Int. Cl.[5] ..... B24B 5/00; B24B 21/16; B24B 19/12

[52] U.S. Cl. ..... 51/154; 51/145 R

[58] Field of Search ..... 51/154, 150, 155, 289 R, 51/149, 281 C, 62; 81/57.19, 57.16, 57.15, 57.33, 57.34, 57.2, 57.17, 57.24, 57.35

[56] References Cited

U.S. PATENT DOCUMENTS

| | | | |
|---|---|---|---|
| 1,493,543 | 3/1935 | Egger | 51/154 X |
| 3,041,792 | 7/1962 | La Fleur | 51/154 |
| 4,402,239 | 9/1983 | Mooney | 81/57.16 |
| 4,682,444 | 7/1987 | Judge et al. | 51/154 |
| 4,747,234 | 5/1988 | Weber | 51/154 |

FOREIGN PATENT DOCUMENTS

| | | |
|---|---|---|
| 8602817 | 2/1986 | Fed. Rep. of Germany . |
| 8602817 | 4/1986 | Fed. Rep. of Germany . |
| 1334361 | 12/1970 | United Kingdom . |
| 1334361 | 7/1991 | United Kingdom . |

OTHER PUBLICATIONS

European Patent Search Report.

*Primary Examiner*—James G. Smith
*Assistant Examiner*—Bruce P. Watson
*Attorney, Agent, or Firm*—Oliff & Berridge

[57] ABSTRACT

For the purpose of machining each journal (2,3) of the workpiece (1), the machine comprises three abrasive application blocks (**13, 16*a*, 16*b*), one of which is mounted in a fixed position on the arm (7) and the other two are mounted on two jaws (14*a*, 14*b*) articulated on the arm (7), in such a way that, when the two jaws (14*a*, 14*b*) are clamped together, after the arm (7) has been lowered onto the journal to be machined, the three blocks (13, 16*a*, 16*b*) are arranged at the angles of an equilateral triangle and exert a uniform, controllable pressure on the workpiece (1**).

11 Claims, 3 Drawing Sheets

MACHINE FOR THE ABRASIVE MACHINING OF CYLINDRICAL JOURNALS ON COMPONENTS, IN PARTICULAR FOR MACHINING JOURNALS AND CRANK PINS ON CRANKSHAFTS USING ABRASIVE MATERIAL

BACKGROUND OF THE INVENTION

The present invention relates to a device for the abrasive machining of cylindrical journals on components, in particular for machining journals and crank pins on crankshafts using abrasive material (an abrasive strip), including, for the purpose of machining each journal, an arm which is mounted so that it can pivot freely about a horizontal pin on a vertically mobile slide and which comprises, on its lower portion, two jaws that can be clamped against one another and carrying means for applying the abrasive against the journal to be machined when the jaws are clamped together.

On known machines for abrasive machining of this type, as marketed, for example, for many years now by the Applicant, with a view to the simultaneous superfinishing of shaft journals and more especially of the journals and crank pins of crankshafts, the two jaws of each arm each comprise two blocks for applying the abrasive strip to the journal to be machined, this application being realized through the clamping effect produced by spring washers fixed to one of the two jaws.

This way of applying the abrasive against the journal to be machined leads to application pressures that are practically uncontrollable and that are not the same on the different application means of each arm.

Furthermore, in the event of the journal for machining being off-centered in relation to the axis of rotation of the workpiece which is rotated about this axis during machining, the arm becomes unbalanced owing to the masses of the arm set in motion when the workpiece is rotated about its axis.

Finally, hitherto, when machining workpieces comprising off-centered journals, it is essential to index the workpiece from the outset, that is to say to position it angularly about its axis of rotation so that the axes of the off-centered journals are located in one and the same vertical plane containing the axis of rotation of the workpiece, before engaging the arm or arms with the workpiece. Indeed, the arms of these known machines cannot position themselves of their own accord on laterally offset off-centered journals.

SUMMARY OF THE INVENTION

One object of the invention is to provide a machining device of the above-mentioned type that is designed in such a way as to permit clamping giving application pressures that are precisely controllable and uniform on the journals to be machined.

Another object of the invention is to provide a device of the above-mentioned type permitting balancing of the arm or arms when machining off-centered journals.

Finally, the object of the invention is to provide a device of the above-mentioned type enabling each arm to center itself of its own accord on the journal to be machined on the workpiece, even in the case of off-centered journals, whatever the angular position of these off-centered journals in relation to the axis of rotation, thus dispensing with the need for angular indexing of the workpiece.

On the machining device according to the invention, each arm has three means for applying the abrasive against the journal for machining, a first one in a fixed median position on the arm for applying the abrasive from above onto the journal to be machined, and the other two in lateral positions on the two jaws to apply the abrasive from either side and from below against the said journal, when the jaws are clamped together, thus permitting isostatic (3-point) clamping.

Advantageously, the two jaws articulated on the arms are coupled in such a way as to pivot synchronously in opposition in relation to the arm, through the action of a common operating means having a controlled clamping effect. Preferably, the said common operating means takes the form of a jack with a controlled supply pressure.

According to one particularly simple form of embodiment, the two jaws are coupled by gears, with each arm carrying a gear wheel engaging with the gear wheel of the other jaw.

With a view to balancing the arm, even when machining off-centered journals, it is advantageous for the arm to be mobile in relation to the slide through the action of a jack with a controlled supply pressure.

Each arm of the machine according to the invention advantageously comprises guide means enabling the arm to center itself on the journal to be machined when the arm is lowered onto the said journal.

These guide means can include on each jaw a first guide which is located below the abrasive applying means provided on this jaw and which comprises a guide surface arranged in such a way that, on the open, that is to say parted, jaws, the two guide surfaces of the two first guides of each arm converge upwardly, the reciprocal distance of the said guide surfaces, on the lower portion thereof, being greater than twice the maximum eccentricity of the off-centered journals.

Preferably, the guide means further include two second guides arranged on the arm, on either side and below the abrasive application means provided on the arm, the two second guides also having upwardly converging guide surfaces.

BRIEF DESCRIPTION OF THE DRAWINGS

An illustrative, non-limitative form of embodiment of the object of the invention will now be described in greater detail with reference to the annexed schematic drawings, wherein.

DETAILED DESCRIPTION OF THE PREFERRED EMBODIMENT

Figure 1:
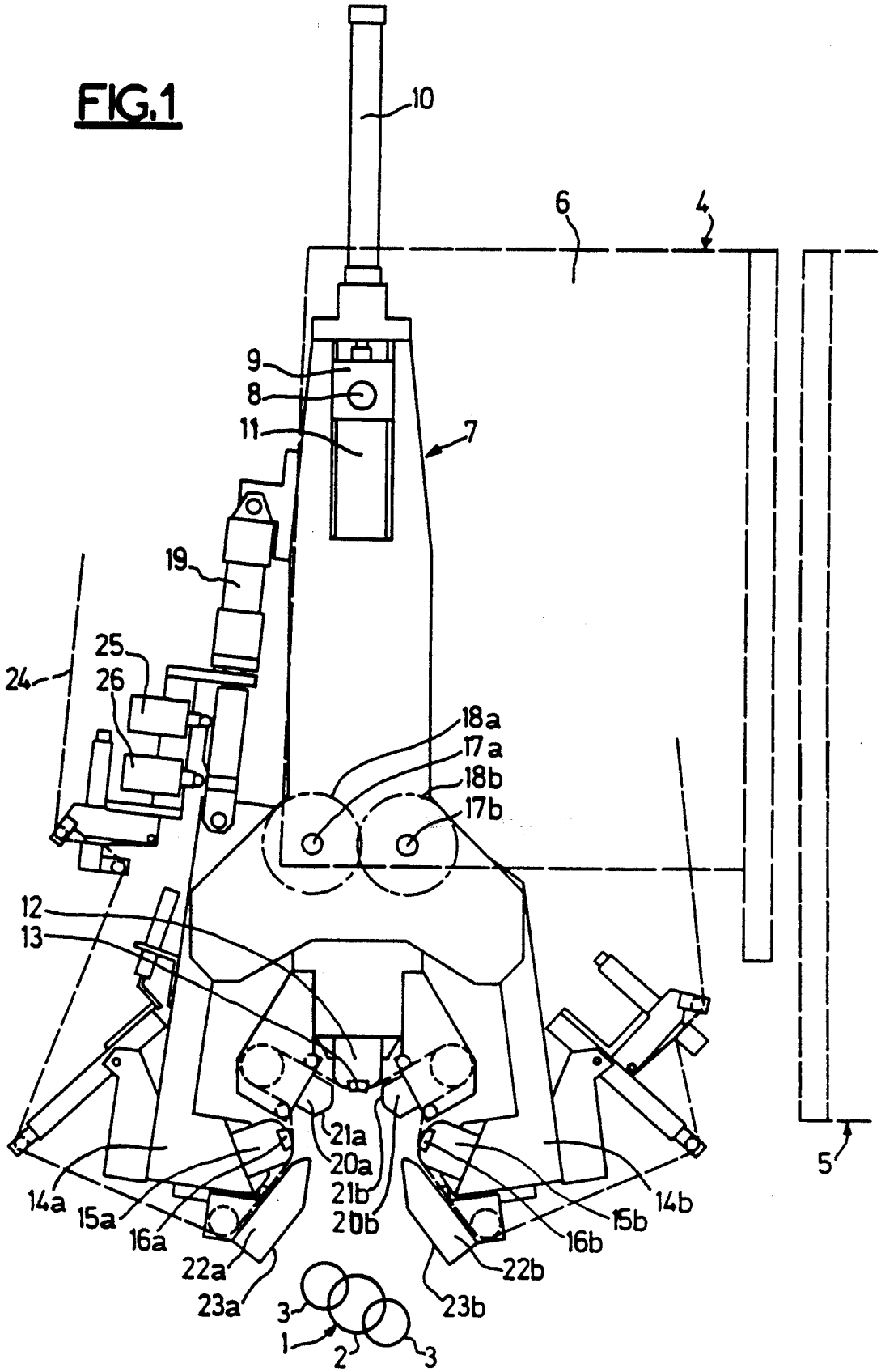
FIG. 1 represents an arm of a machine for abrasive machining according to the invention, the arm being in top position above a journal to be machined, with its jaw open.

The abrasive machining arm, as illustrated by the drawings, forms part of a machine for superfinishing using abrasive strip permitting the simultaneous machining of all or part of the cylindrical journals of a crankshaft 1, whose journals 2 and crank pins 3 are schematically represented.

For this purpose, the machine includes an arm support slide 4 mounted so as to be vertically mobile on a frame 5 through the action of a control means not represented. Between every two flanges 6, slide 4 bears floating arms 7, that is to say arms that are mounted so as to be able to pivot freely about a horizontal pin 8. Horizontal pin 8 is integral with a slide 9 which is mounted so as to be mobile through the action of a jack 10 in a guide way 11 provided on the upper end of arm 7.

At its lower end, arm 7 carries a support 12 fitted with an application block 13, whose function will become clear later. In addition, arm 7 carries, in the vicinity of its lower end, two jaws, 14*a*, 14*b*, each of which is fitted with a support, 15*a*, 15*b* equipped with an application block, 16*a*, 16*b*. The two jaws, 14*a*, 14*b*, are articulated on pins 17*a*, 17*b* on arm 7 and are coupled by two gear wheels, 18*a*, 18*b*, engaging each other. A jack 19 mounted between the arm 7 and jaw 14*a* enables the latter to be pivoted about pin 17*a* and, owing to the coupling of the two jaws 14*a*, 14*b* via gear wheels 18*a*, 18*b*, enables the other jaw, 14*b*, to be pivoted simultaneously in synchronism in the opposite direction.

Figure 3:
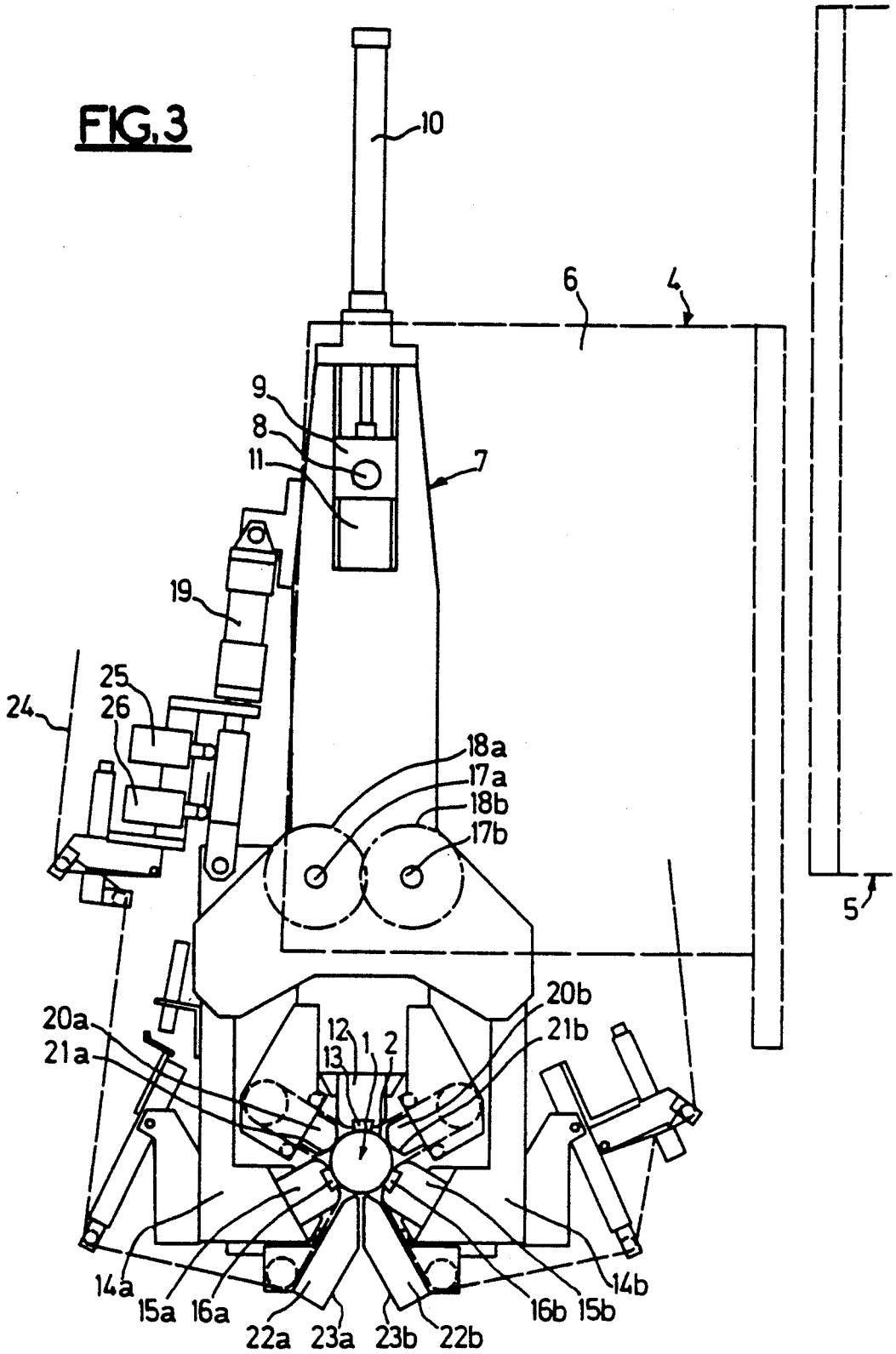
FIG. 3 represents the machining arm in lowered position, with the jaws closed over the journal to be machined.

The articulation of jaws 14*a*, 14*b* on arm 7 and the arrangement of supports 15*a*, 15*b* on jaws 14*a*, 14*b* are chosen in such a way that, when arm 7 is lowered onto the workpiece and jaws 14*a*, 14*b* are clamped around the said workpiece by jack 19, as represented in FIG. 3, the three supports, 12, 15*a*, 15*b*, and the application blocks, 13, 16*a* and 16*b* of these supports, are arranged substantially at the angles of an equilateral triangle, block 13 fixed to arm 7 bearing on the workpiece from above and the two blocks, 16*a*, 16*b*, fixed to the two jaws 14*a*, 14*b* bearing from below and from either side on the said workpiece.

In addition, arm 7 bears two guides, 20*a*, 20*b*, placed on either side of support 12, the two guides having guide surfaces, 21*a*, 21*b*, located below block 13 and converging upwardly, in such a way that, when arm 7 is lowered onto the workpiece 1 to be machined, guides 20*a*, 20*b* ensure the self-centering of said arm 7, hence of block 13, in relation to workpiece 1.

Furthermore, each of the two jaws 14*a*, 14*b* bears, below its support 15*a*, 15*b*, a guide 22*a*, 22*b* having a guide surface 23*a*, 23*b*. Guides 22*a*, 22*b* are formed and arranged in such a way that, when the two jaws, 14*a*, 14*b*, are open (see FIGS. 1 and 2), guide surfaces 23*a*, 23*b* converge upwardly, their maximum reciprocal spacing on the lower portion being greater than twice the maximum eccentricity of the crank pins of the workpiece 1 and their minimum reciprocal spacing being substantially equal to the maximum reciprocal distance of guide surfaces 21*a*, 21*b* of the two fixed guides 20*a*, 20*b*.

Each arm 7 is further equipped with a guide and tensioning assembly for an abrasive strip 24. This assembly is designed in such a way as to cause the abrasive strip 24 to pass over the three blocks 13, 16*a* and 16*b* and includes a set of guide and intermediate pulleys by means of which abrasive strip 24 circumvents guide surfaces 21*a*, 21*b*, 23*a*, 23*b*. This guide and tensioning assembly is not the object of the present invention and will not be described in further detail herein.

Figure 2:
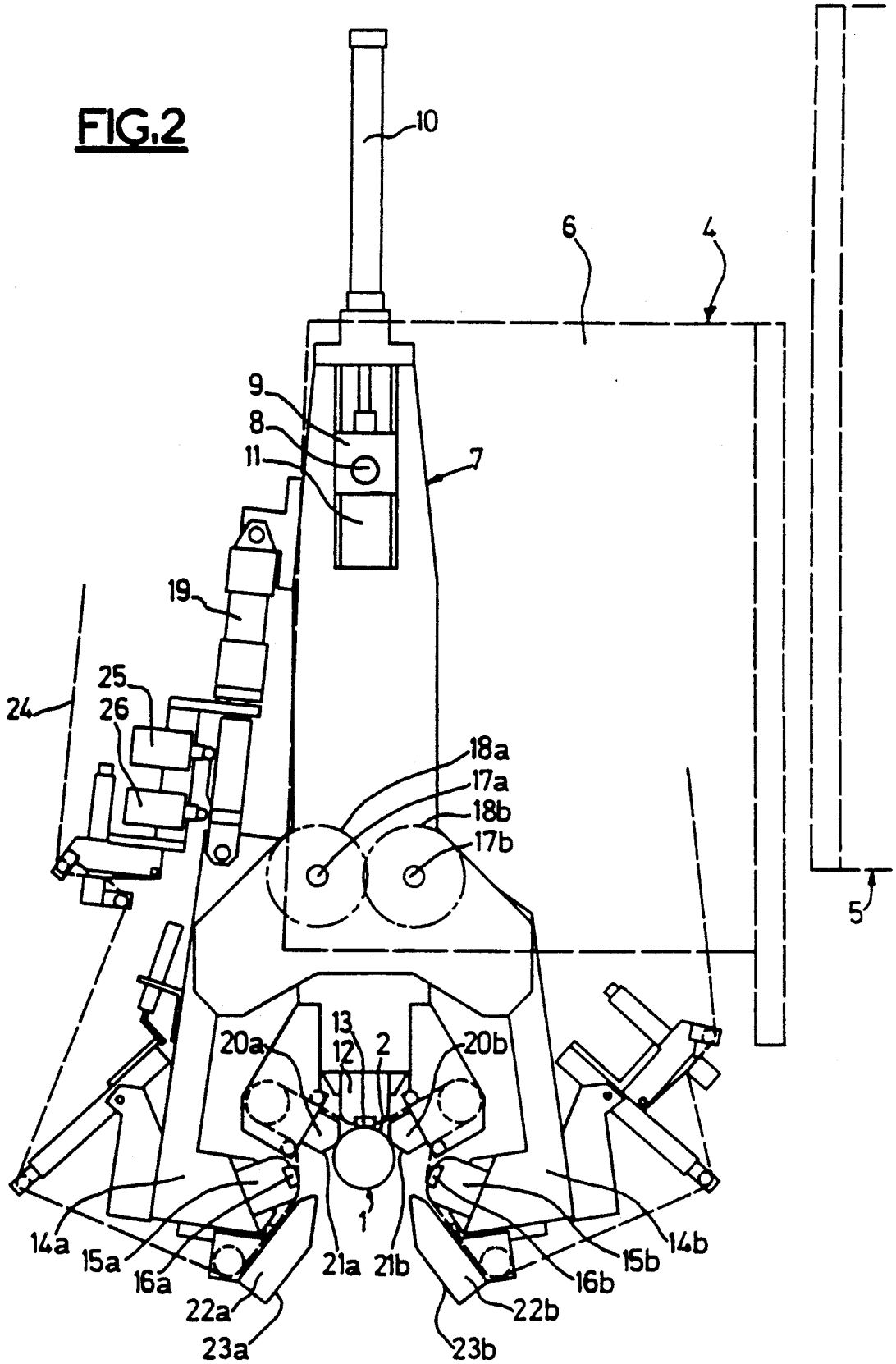
FIG. 2 represent the machining arm in lowered position over the journal to be machined, with the jaws open.

With reference to FIGS. 1, 2 and 3, we shall now describe the mode of operation of the device according to the invention.

In order to machine all or part of the cylindrical journals of a workpiece 1, for example, all or part of the journals 2 and/or the crank pins 3 of a crankshaft, using a multiple device including, on one and the same slide 4, as many arms 7 as the crankshaft 1 comprises journals to be machined simultaneously, the crankshaft 1 is placed below the floating arms 7 of the slide 4 raised to its top position, jaws 14*a*, 14*b* of arms 7 being open (FIG. 1). Crankshaft 1 is supported, in a manner known per se, for example between two centers, and is driven in rotation during the machining of the journals, about its axis of rotation defined by the axis of journals 2.

When crankshaft 1 has been brought vertically below arms 7, as illustrated in FIG. 1, slide 4 is lowered so that each arm 7 is centered in relation to the cylindrical journal that it is to machine (journal 2, crank pin 3), thanks to the guide surfaces 23*a*, 23*b* of guides 22*a*, 22*b* and the guide surfaces 21*a*, 21*b* of guides 20*a*, 20*b*, which brings block 13 of arm 7 onto the cylindrical journal to be machined (FIG. 2).

In the example shown in the figures, arm 7 as illustrated, is designed for the purpose of machining a journal 2 of crankshaft 1.

Next, the two jaws, 14*a*, 14*b*, are clamped together by operating jack 19, whose travel is controlled by two stops, 25, 26, which can be adjusted according to the diameter of the journal to be machined, so that two blocks 16*a*, 16*b* are applied laterally from below against cylindrical journal 2 to be machined, by means of the coupling of the two jaws 14*a*, 14*b* by gear wheels 18*a*, 18*b*. The three blocks, 13, 16*a*, 16*b*, thus bear with uniform pressure against journal 2 to be machined, substantially at the three angles of an equilateral triangle, and thus apply the abrasive strip 24 with uniform pressure against journal 2 (FIG. 3). It then suffices to drive workpiece 1 in rotation about its axis of rotation to ensure that journal 2 is uniformly machined.

When the journals 2 of a crankshaft 1 are being machined, the driving in rotation of crankshaft 1 about its axis of rotation, hence about the axis of journals 2, gives rise to practically no movement (pivotal, ascending or descending) of arms 7.

The same does not apply when machining off-centered cylindrical journals, for example crank pins 3 of a crankshaft 1. Indeed, when the crankshaft is rotated about its axis of rotation, these crank pins 3, off-centered in relation to the axis of rotation (the axis of the journals 2), describe a circular trajectory that is off-centered in relation to the axis of rotation. Each arm 7 that has to machine such an off-centered journal thus has to be able to follow this movement of the journal to be machined, without the said arm being unbalanced by the effects deriving from the mass of the arm set in motion by workpiece 1 when the latter rotates.

Balancing of arm 7 of the device according to the invention is ensured by jack 10, which exerts a constant force upon the said arm, whatever the position of the latter.

This balancing of arm 7 by jack 10, in conjunction with the isostatic clamping of the three blocks, 13, 16*a*, 16*b*, owing to the two coupled jaws, 14*a*, 14*b*, makes it possible to ensure uniform, controllable clamping of the three blocks on the journal to be machined.

I claim:

1. A machine for abrasive machining cylindrical journals on workpieces having an axis of rotation by means of abrasive strips applied against the journals to be machined while the workpiece is rotated about said axis extending horizontally, comprising:

a frame;

a main slide vertically movable on said frame;

a plurality of elongated floating arms having two opposed ends, each of said arms comprising near a first of said ends a longitudinal extending guideway for a slide hinged about a horizontal pin on said main slide so that each arm can freely pivot about said pin, each said arm carrying near its other end two jaws hinged about horizontal axes on said arm and coupled together in such a way that they can pivot with respect to said arm synchronously in opposition one to another, each of said floating arms hanging freely under gravity in a vertical direction from said horizontal pin and being pivotally displaceable from a vertical orientation by contact of a portion of said other end of each arm with a workpiece when said arm is lowered by the main slide, whereby an off-centered journal of the workpiece to be machined can be located within said two jaws without requiring an adjustment of an angular orientation of the workpiece;

a fluid-operated jack between each of said arms and each of said slides, each said jack having a controlled supply pressure such that the weight of said arm is substantially balanced;

operating means comprising a fluid-operated jack having a controlled supply pressure for closing said two jaws of each said arm with a controlled clamping effect; and three abrasive applying means for applying an abrasive strip extending between said two jaws against each of said journals to be machined while the workpiece is rotated;

whereby said three means apply said abrasive strip with uniform pressure against the journal to be machined by rotation of said workpiece about its axis of rotation, even if said journal is off-centered with respect to said axis of rotation.

2. The machine of claim 1, wherein said two jaws of each said arm are coupled by gears, each jaw comprising a gear wheel engaging with a gear wheel of the other jaw.

3. The machine of claim 1, wherein each said arm comprises guide means enabling said arm to center itself on said journal to be machined when said arm is lowered onto said journal by said main slide, the jaws being open.

4. The machine of claim 3, wherein said guide means include on each of said two jaws, a guide located below said abrasive applying means and comprising a guide surface arranged in such a way that, said two jaws being open, said two guide surfaces converge upwardly, the distance between said two guide surfaces, on the lower portion thereof, being greater than twice the maximum eccentricity of the off-centered journal to be machined.

5. The machine of claim 3, wherein said guide means include two guides located on said arm on either side and below said abrasive applying means, said guides having upwardly converging guide surfaces.

6. A machine for abrasive machining cylindrical journals on workpieces having an axis of rotation by means of abrasive strips applied against the journals to be machined while the workpiece is rotated about said axis extending horizontally, comprising:

a frame;

a main slide vertically movable on said frame;

a plurality of elongated floating arms having two opposed ends, each of said arms comprising near a first of said ends a longitudinal extending guideway for a slide hinged about a horizontal pin on said main slide so that each arm can freely pivot about said pin, each said arm carrying near its other end two jaws hinged about horizontal axes on said arm and coupled together in such a way that they can pivot with respect to said arm synchronously in opposition one to another, each of said floating arms hanging freely under gravity in a vertical direction from said horizontal pin and being pivotally displaceable from a vertical orientation by contact of a portion of said other end of each arm with a workpiece when said arm is lowered by the main slide, whereby an off-centered journal of the workpiece to be machined can be located within said two jaws without requiring an adjustment of an angular orientation of the workpiece;

a fluid-operated jack between each of said arms and each of said slides, each said jack having a controlled supply pressure such that the weight of said arm is substantially balanced;

operating means comprising a fluid-operated jack having a controlled supply pressure for closing said two jaws of each said arm with a controlled clamping effect;

three abrasive applying means for applying an abrasive strip against each of said journals to be machined, a first one located in a median position at said second end of each said arm, and the two others in lateral positions each on one of said two jaws such that if applied by said operating means against the journal to be machined, said three means are located substantially at the three angles of an equilateral triangle, whereby said three means apply said abrasive strip with uniform pressure against the journal to be machined by rotation of said workpiece about its axis of rotation, even if said journal is off-centered with respect to said axis of rotation; and guide means on each said arm enabling said arm to center itself on said journal to be machined when said arm is lowered onto said journal by said main slide, the jaws being open.

7. The machine of claim 6, wherein said two jaws of each said arm are coupled by gears, each jaw comprising a gear wheel engaging with a gear wheel of the other jaw.

8. A machine for abrasive machining cylindrical journals on workpieces having an axis of rotation by means of abrasive strips applied against the journals to be machined while the workpiece is rotated about said axis extending horizontally, comprising:

a frame;

a main slide vertically movable on said frame;

a plurality of elongated floating arms having two opposed ends, each of said arms comprising near a first of said ends a longitudinal extending guideway for a slide hinged about a horizontal pin on said main slide so that each arm can freely pivot about said pin, each said arm carrying neat its other end two jaws hinged about horizontal axes on said arm and coupled together in such a way that they can pivot with respect to said arm synchronously in opposition one to another, each of said floating arms hanging freely under gravity in a vertical direction from said horizontal pin and being pivotally displaceable from a vertical orientation by contact of a portion of said other end of each arm with a workpiece when said arm is lowered by the main slide, whereby an off-centered journal of the workpiece to be machined can be located within said two jaws without requiring an adjustment of an angular orientation of the workpiece;

a fluid-operated jack between each of said arms and each of said slides, each said jack having a controlled supply pressure such that the weight of said arm is substantially balanced;

operating means comprising a fluid-operated jack having a controlled supply pressure for closing said two jaws of each said arm with a controlled clamping effect; and abrasive applying means for applying an abrasive strip extending between said two jaws against each of said journals to be machined while the workpiece is rotated;

wherein each said arm comprises guide means enabling said arm to center itself on said journal to be machined when said arm is lowered onto said journal by said main slide, the jaws being open; and wherein said guide means include on each of said two jaws, a guide located below said abrasive applying means and comprising a guide surface arranged in such a way that, said two jaws being open, said two guide surfaces converge upwardly, the distance between said two guide surfaces, on the lower portion thereof, being greater than twice the maximum eccentricity of the off-centered journal to be machined.

9. A machine for abrasive machining cylindrical journals on workpieces having an axis of rotation by means of abrasive strips applied against the journals to be machined while the workpiece is rotated about said axis extending horizontally, comprising:

a frame;

a main slide vertically movable on said frame;

a plurality of elongated floating arms having two opposed ends, each of said arms comprising near a first of said ends a longitudinal extending guideway for a slide hinged about a horizontal pin on said main slide so that each arm can freely pivot about said pin, each said arm carrying near its other end two jaws hinged about horizontal axes on said arm and coupled together in such a way that they can pivot with respect to said arm synchronously in opposition one to another, each of said floating arms hanging freely under gravity in a vertical direction from said horizontal pin and being pivotally displaceable from a vertical orientation by contact of a portion of said other end of each arm with a workpiece when said arm is lowered by the main slide, whereby an off-centered journal of the workpiece to be machined can be located within said two jaws without requiring an adjustment of an angular orientation of the workpiece;

a fluid-operated jack between each of said arms and each of said slides, each said jack having a controlled supply pressure such that the weight of said arm is substantially balanced;

operating means comprising a fluid-operated jack having a controlled supply pressure for closing said two jaws of each said arm with a controlled clamping effect; and abrasive applying means for applying an abrasive strip extending between said two jaws against each of said journals to be machined while the workpiece is rotated;

wherein each said arm comprises guide means enabling said arm to center itself on said journal to be machined when said arm is lowered onto said journal by said main slide, the jaws being open; and wherein said guide means include two guides located on said arm on either side and below said abrasive applying means, said guides having upwardly converging guide surfaces.

10. A machine for abrasive machining cylindrical journals on workpieces having an axis of rotation by means of abrasive strips applied against the journals to be machined while the workpiece is rotated about said axis extending horizontally, comprising:

a frame;

a main slide vertically movable on said frame;

a plurality of elongated floating arms having two opposed ends, each of said arms comprising near a first of said ends a longitudinal extending guideway for a slide hinged about a horizontal pin on said main slide so that each arm can freely pivot about said pin, each said arm carrying near its other end two jaws hinged about horizontal axes on said arms and coupled together in such a way that they can pivot with respect to said arm synchronously in opposition one to another, each of said floating arms hanging freely under gravity in a vertical direction from said horizontal pin and being pivotally displaceable from a vertical orientation by contact of a portion of said other end of each arm with a workpiece when said arm is lowered by the main slide, whereby an off-centered journal of the workpiece to be machined can be located within said two jaws without requiring an adjustment of an angular orientation of the workpiece;

a fluid-operated jack between each of said arms and each of said slides, each said jack having a controlled supply pressure such that the weight of said arm is substantially balanced;

operating means comprising a fluid-operated jack having a controlled supply pressure for closing said two jaws of each said arm with a controlled clamping effect;

three abrasive applying means for applying an abrasive strip against each of said journals to be machined, a first one located in a median position at said second end of each said arm, and the two others in lateral positions each on one of said two jaws such that if applied by said operating means against the journal to be machined, said three means are located substantially at the three angles of an equilateral triangle, whereby said three means apply said abrasive strip with uniform pressure against the journal to be machined by rotation of said workpiece about its axis of rotation, even if said journal is off-centered with respect to said axis of rotation; and guide means on each said arm enabling said arm to center itself on said journal to be machined when said arm is lowered onto said journal by said main slide, the jaws being open;

wherein said guide means include on each of said two jaws, a guide located below said other abrasive applying means on said jaw and comprising a guide surface arranged in such a way that, said two jaws being open, said two guide surfaces converge upwardly, the distance between said two guide surfaces, on the lower portion thereof, being greater than twice the maximum eccentricity of the off-centered journal to be machined.

11. A machine for abrasive machining cylindrical journals on workpieces having an axis of rotation by means of abrasive strips applied against the journals to be machined while the workpiece is rotated about said axis extending horizontally, comprising:

a frame;

a main slide vertically movable on said frame;

a plurality of elongated floating arms having two opposed ends, each of said arms comprising near a first of said ends a longitudinal extending guideway for a slide hinged about a horizontal pin on said main slide so that each arm can freely pivot about said pin, each said arm carrying near its other end two jaws hinged about horizontal axes on said arms and coupled together in such a way that they can pivot with respect to said arm synchronously in opposition one to another, each of said floating arms hanging freely under gravity in a vertical direction from said horizontal pin and being pivotally displaceable from a vertical orientation by contact of a portion of said other end of each arm with a workpiece when said arm is lowered by the main slide, whereby an off-centered journal of the workpiece to be machine can be located within said two jaws without requiring an adjustment of an angular orientation of the workpiece;

a fluid-operated jack between each of said arms and each of said slides, each said jack having a controlled supply pressure such that the weight of said arm is substantially balanced;

operating means comprising a fluid-operated jack having a controlled supply pressure for closing said two jaws of each said arm with a controlled clamping effect;

three abrasive applying means for applying an abrasive strip against each of said journals to be machined, a first one located in a median position at said second end of each said arm, and the two others in lateral positions each on one of said two jaws such that if applied by said operating means against the journal to be machined, said three means are located substantially at the three angles of an equilateral triangle, whereby said three means apply said abrasive strip with uniform pressure against the journal to be machined by rotation of said workpiece about its axis of rotation, even if said journal is off-centered with respect to said axis of rotation; and guide means on each said arm enabling said arm to center itself on said journal to be machined when said arm is lowered onto said journal by said main slide, the jaws being open;

wherein said guide means include two guides located on said arm on either side and below said first abrasive applying means on the arm, said guides having upwardly converging guide surfaces.

* * * * *